United States Patent [19]

Clifton

[11] 4,367,605

[45] Jan. 11, 1983

[54] SIGN FOR COIN-OPERATED MACHINE

[76] Inventor: Hampton A. Clifton, 4307 El Carnal Way, Las Vegas, Nev. 89121

[21] Appl. No.: 247,864

[22] Filed: Mar. 23, 1981

[51] Int. Cl.[3] ..... G09F 7/00

[52] U.S. Cl. ..... 40/584; 40/124.1; 40/152.1

[58] Field of Search ..... 40/2 R, 585, 124.1, 40/310, 309

[56] References Cited

U.S. PATENT DOCUMENTS

| | | | |
|---|---|---|---|
| 286,112 | 10/1883 | Buck | 40/309 |
| 813,764 | 2/1905 | Bailey | 40/310 |
| 892,398 | 7/1909 | Canham | 40/309 |
| 1,343,054 | 6/1920 | Hurlbut | 409/124.1 |
| 1,564,752 | 12/1925 | Brown | 40/310 |
| 1,593,193 | 7/1926 | Ryno | 40/2 R |
| 1,632,475 | 6/1927 | Hoefler | 40/310 |
| 2,599,111 | 6/1952 | Kicher | 40/19.0 |
| 3,585,747 | 6/1971 | Erickson | 40/124.1 |
| 4,197,808 | 4/1980 | Kinninger | 40/607.0 |

*Primary Examiner*—Gene Mancene
*Assistant Examiner*—Wenceslao J. Contreras
*Attorney, Agent, or Firm*—Seiler & Quirk

[57] ABSTRACT

Sign apparatus for indicating that a coin-operated machine is out of order has an upper sign portion indicating the inoperative condition of the machine and a guide member which extends into the coin chute of the machine. A pair of biased legs having fastening members at their extremities depend outwardly from the guide member and engage ledges in the interior of the coin chute to hold the sign in place.

4 Claims, 4 Drawing Figures

SIGN FOR COIN-OPERATED MACHINE

BACKGROUND OF THE INVENTION

This invention relates to a sign for indicating to a prospective user of a coin-operated machine that the machine is inoperative. The sign locks into the coin slot, thereby ensuring that a user of the machine will not accidentally fail to notice the warning.

Coin-operated machines are used for many purposes, including dispensing food items such as candy, fruit, and gum, drinks such as carbonated beverages and coffee, and for various gaming devices such as slot machines. These machines occasionally malfunction, refusing to accept coins or to dispense the desired product or service. The frequency of inoperability of slot machines is particularly high, because of the large volume of coins which are fed into the machine in a relatively short period of time. These machines also have relatively sophisticated accept/reject mechanisms, which must differentiate between coins of different denominations and counterfeit coins, and which require very sensitive calibrations; therefore, although breakdowns may be relatively easy to repair, the frequency is high.

When a coin-operated machine breaks down, it is not uncommon for the person who finds the inoperable condition to tape a piece of paper to the machine indicating that it is out of order. Alternatively, someone may simply place a piece of adhesive tape over the coin slot, thereby indicating to a subsequent user that a problem exists with the machine. In casinos which contain a large number of coin-operated devices, the casino may have preprinted signs indicating that a machine is out of order that attendants may apply to the machine when a problem is found. In all of these cases, the signs are easily removed, are unsightly, and may not be sufficiently obvious to one who wishes to use the machine to prevent oversight.

The present invention consists of a sign bearing the words "OUT OF ORDER", or a similar warning, which may be inserted in the coin slot of a coin-operated machine in such a manner as to prevent insertion of coins into the slot. The sign also contemplates locking means to prevent removal of the sign by someone who attempts to lift the sign from the slot.

Accordingly, it is an object of the invention to provide a sign displaying an inoperative condition of a coin machine which fits into the coin slot of the machine, thereby preventing insertion of a coin in the slot. It is a further object of the invention to provide a sign which cannot be removed from the coin slot by lifting the sign, and yet is easily removed from the slot by someone who understands the construction of the sign. These and other objects of the invention will be apparent from the following description of a preferred embodiment thereof.

SUMMARY OF THE INVENTION

A display device for indicating the inoperative condition of a coin-operated apparatus comprises display means having a surface for bearing a warning message, a guide member adapted to extend into a coin slot, and a pair of downwardly and outwardly extending legs biased outwardly from the guide member, each leg having an outwardly extending foot at its end adapted to engage a ledge in a coin chute.

BRIEF DESCRIPTION OF THE DRAWINGS

The invention is better understood with reference to the drawings, in which.

DETAILED DESCRIPTION OF A PREFERRED EMBODIMENT

Figure 1:
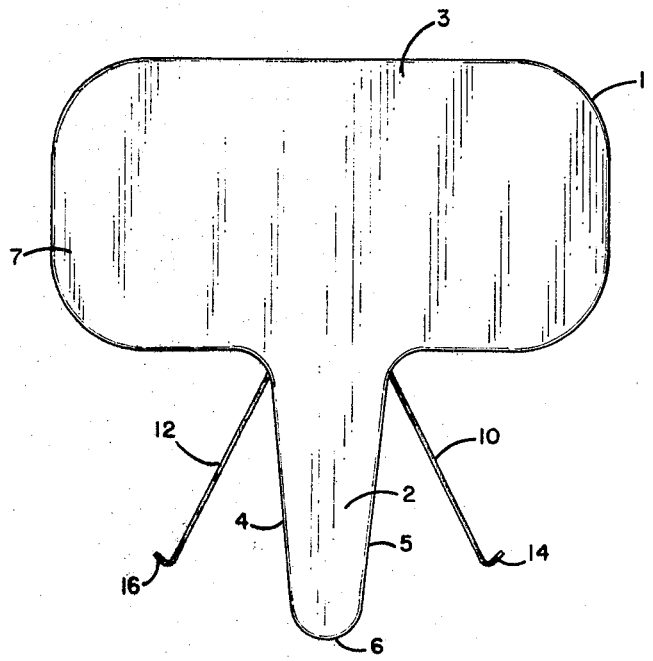
FIG. 1 is a front view of a sign of the invention.

The sign of the invention has an upper word bearing surface portion and a downwardly extending guide member portion, and has two outwardly biased legs which retain the sign in a coin slot. Referring to FIG. 1, sign 1 has a substantially rectangular upper portion 7, from which a downwardly extending guide member portion 2 depends. The front surface 3 of the upper portion of the sign is adapted to carry a message of inoperativeness, such as "OUT OF ORDER", although such message is not shown in FIG. 1. The guide member has tapered edges 4 and 5 and a rounded bottom portion 6. Legs 10 and 12 extend downwardly and outwardly from the upper portion of the sign at the top of the guide member, and terminate at their extremity in a pair of short feet or hooks 14 and 16 which act as retaining means to hold the sign in place in a coin slot. The legs are resilient but are sufficiently flexible to be easily squeezed together between the thumb and forefinger for insertion into a coin slot; upon insertion, the legs thrust outwardly until they engage the wall of the coin slot.

Figure 2:
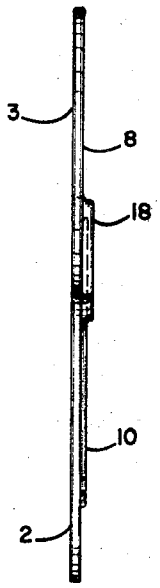
FIG. 2 is a side view thereof.
Figure 3:
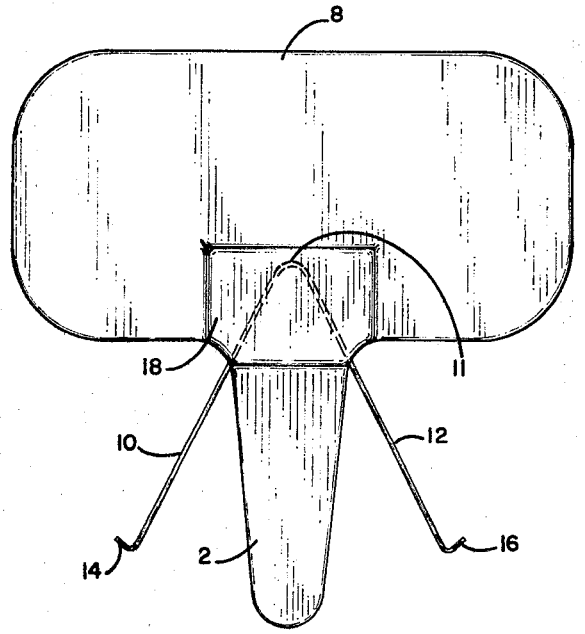
FIG. 3 is a back view thereof.

Construction of the sign is most easily seen in FIGS. 2 and 3. As shown, the legs are fabricated from a single piece of 15.5 gauge piano wire which is cut to the desired length and is bent centrally at apex 11, and crimped at the ends at an angle of approximately 90° to form feet 14 and 16. Any stiff wire or structural equivalent (e.g., plastic member) may be used; 10–20 gauge wire is preferred. The wire is then permanently attached to the rear surface 8 of the upper portion of the sign with a fastening strip 18 which is attached to the sign by an adhesive or by heat sealing. The sign may be made from any material, such as metal, wood, or plastic, but is preferably made from a thermoplastic material such as PVC, polyethylene, polypropylene, or the like. These thermoplastic materials can be manufactured and imprinted very inexpensively, and are easily assembled by securing the legs to the sign. In the present instance, the legs are secured by a strip of like thermoplastic material 18 which is cut to fit the contour of the guide member and which is attached over the upper portion of the piano wire with a rapidly setting glue. The legs could also be heat sealed in place by a short application of a temperature sufficient to melt the plastic and thereby bond the sealing strip 18 to the rear surface 8 of the sign. Obviously, any method of attachment of leg members to the sign may be used.

Figure 4:
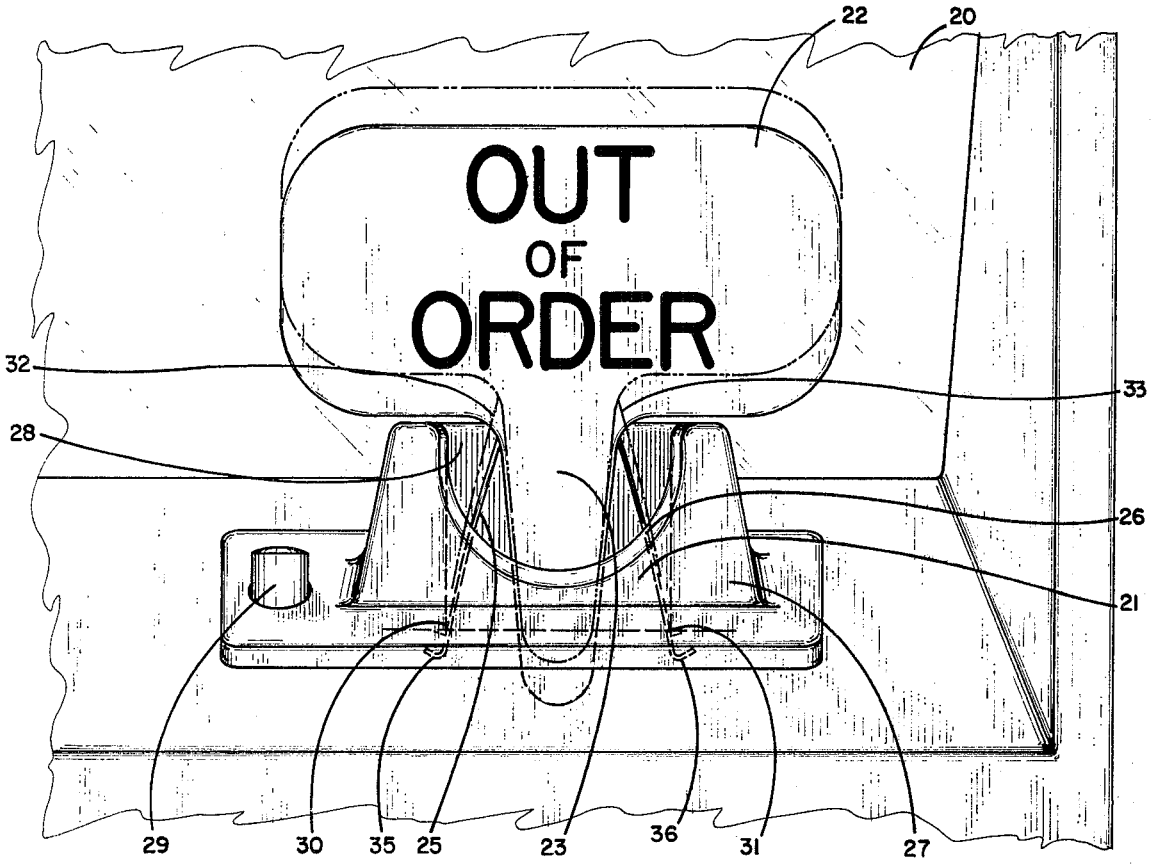
FIG. 4 is a front perspective view of a sign of the invention mounted in a coin slot of a coin-operated apparatus, with the degree of movement of the sign in the slot shown in phantom.

FIG. 4 shows the display means of the invention in use in a coin slot. Sign 22, which is constructed similarly to the sign shown in FIG. 1 but bears the legend "OUT OF ORDER", is shown mounted in the coin slot 28 of the coin receiver 27 of coin-operated machine 20. Also shown in coin return push button 29. In the particular coin slot shown in FIG. 4, a front portion of the slot is open and defined by a semi-circular rim 24; in many slot machines the front wall of the coin chute is coextensive with the rear wall, and therefore very little of the guide member can be seen when the sign is in place. In the case of machines having a semi-circular opening of the type shown in FIG. 4, it is sometimes desirable to use a sign having a guide member of greater width, thereby disguising the existence of the legs 25 and 26.

In most coin-operated machines, it is common for the chute 21 to be only slightly greater than the diameter of the largest coin acceptable to the machine. Slightly below the coin opening, however, the width of the chute expands slightly, thereby creating a pair of ledges 30 and 31 on opposing sides of the interior of the chute. The feet 35 and 36 at the ends of the legs engage these ledges as the sign is lifted from the coin chute, thereby preventing its removal.

Insertion and removal of the sign of the invention is very simply. The sign is inserted by squeezing the legs with the thumb and forefinger such that the distance between the feet is smaller than the coin slot opening, and sliding the guide member down into the coin slot. When the pressure on the legs is released, the natural bias of the wire legs causes the legs to expand toward their normal position. When the feet of the sign have extended downwardly past the ledges in the coin chute, the legs will extend outwardly and the feet will engage the ledges. Once inserted, the sign can only be lifted about $\frac{1}{4}''$-$\frac{3}{8}''$ before the feet engage the ledges. The sign may be removed by squeezing the legs together at the top, e.g., with a pair of thin-nosed pliers, or by depressing one leg at the top with a blunt instrument, such as a screwdriver, tilting the sign to free the depressed leg from the ledge, and then depressing the opposing leg and lifting the sign from the chute. A particular advantage of the sign is that it is easy to insert and remove, but is difficult to remove by someone who wishes to steal the sign because the mechanism of locking the sign in place in the coin slot is not immediately obvious.

While the sign may be made of any size, the upper portion of the sign is about $3\frac{1}{2}''$ by $1\frac{3}{4}''$ with the guide member extending approximately 2" from the upper portion. The portion of the legs visible in FIG. 1 is about $1\frac{1}{2}''$. It will be immediately apparent to one skilled in the art that many modifications may be made in the sign of the invention, which may bear any legend and may be made from any material; similarly, any mechanism for fastening the legs to the body of the sign may be employed. Accordingly, the invention should not be considered limited by the foregoing description of a preferred embodiment, but rather should be limited only by the following claims.

I claim:

1. A sign for indicating the inoperative condition of a coin-operated apparatus having a coin slot for receiving coins comprising display means, a flat guide member adapted to fit into the coin slot, and fastening means for removably attaching the sign of the coin-operated apparatus comprising a pair of legs biased outwardly from the guide means.

2. The sign of claim 1 wherein each leg has hook means at its extremity for engaging an interior portion of the coin-operated apparatus.

3. The sign of claim 2 wherein each hook means comprises a foot extending outwardly and upwardly from an end portion of the leg.

4. The sign of claims 1 or 2 wherein each leg is fabricated from stiff wire.

* * * * *